United States Patent [19]

Woodley

[11] 4,184,444

[45] Jan. 22, 1980

[54] TAPERED PLASTIC CONTAINER WITH SEAMED METAL END AND METHOD FOR MAKING IT

[75] Inventor: Keith R. Woodley, San Francisco, Calif.

[73] Assignee: Wescan, Inc., San Francisco, Calif.

[21] Appl. No.: 887,174

[22] Filed: Mar. 16, 1978

Related U.S. Application Data

[62] Division of Ser. No. 793,732, May 4, 1977, Pat. No. 4,102,467.

[51] Int. Cl.[2] ..... B21D 51/34

[52] U.S. Cl. ..... 113/120 XY; 113/120 Y

[58] Field of Search ..... 113/120 XY, 120 Y, 117, 113/114 R; 220/67

[56] References Cited

U.S. PATENT DOCUMENTS

| | | | |
|---|---|---|---|
| 1,824,907 | 9/1931 | Lermer | 113/120 XY |
| 2,082,701 | 6/1937 | Kueffner | 113/120 XY |
| 2,306,375 | 12/1942 | Bach | 113/120 XY |
| 2,633,095 | 3/1953 | Magill et al. | 113/120 XY |
| 3,524,568 | 8/1970 | Nughes | 220/67 |

FOREIGN PATENT DOCUMENTS

| | | | |
|---|---|---|---|
| 480449 | 1/1952 | Canada | 113/120 XY |

*Primary Examiner*—Michael J. Keenan

[57] ABSTRACT

A container which includes a thermoformed or injection molded rigid or semi-rigid plastic body and a metal end seamed upon and closing one open end of the body. Critical shaping of the plastic container body permits seaming a conventional metal end upon the body with conventional seaming techniques and tooling.

2 Claims, 8 Drawing Figures

TAPERED PLASTIC CONTAINER WITH SEAMED METAL END AND METHOD FOR MAKING IT

This application is a division of my application Ser. No. 793,732 filed on May 4, 1977 for Tapered Plastic Container with Metal End and Method for Making It, now U.S. Pat. No. 4,102,467 issued July 25, 1978.

BACKGROUND

For years metal cans have been used to pack and ship a multitude of products for industrial and consumer consumption. Traditionally, such cans comprised a cylindrical metal container body with a metal end seamed upon and closing one or both ends of the body. More recently, others have suggested plastic container bodies sealed with metal ends.

There have been difficulties, however, in applying the hard metal ends to the softer plastic cntainer bodies. For instance, when one tries to seam a metal end onto a plastic body, the sharp metal rolled edge often cuts through the softer plastic material negating an effective seam. Moreover, special exterior molds and supports are usually required to support or envelop the container body to prevent it from being crushed when conventional tooling force is applied during the seaming process.

Among other objectives, the purpose of this invention is to overcome the two above-mentioned difficulties. By designing the container flange with a specific tapered shape, the resulting seam develops a balanced pressure distribution in body hook. Further, by providing a tapered body and a sharp radius at the juncture of the body flange and the remainder of the container body, it is possible to perform the seaming operation techniques and tooling. Special supporting molds can be eliminated because the specifically shaped body, itself, can withstand the resultant smaller forces without danger of buckling.

Other objects and advantages of this invention will become obvious to those skilled in the art upon consideration of the following detailed description and the drawings illustrating a preferred embodiment.

IN THE DRAWINGS

DESCRIPTION OF THE PREFERRED EMBODIMENT

Figure 1:
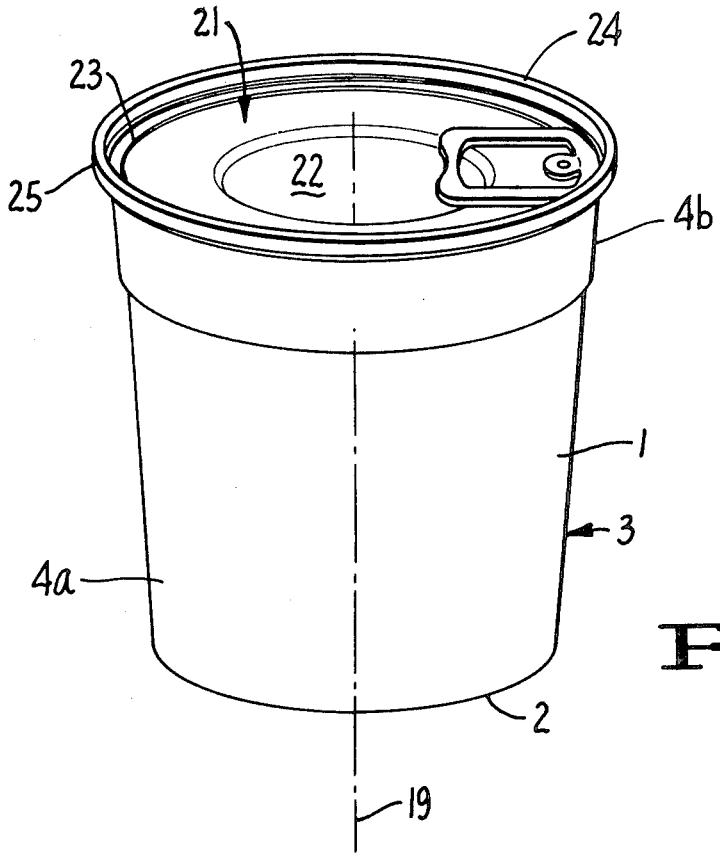
FIG. 1 is a perspective view of the plastic container body with the metal end seamed thereto.

Referring now to the drawings in detail, FIG. 1 illustrates a container having the plastic body and metal end seamed upon it in accordance with this invention. The plastic container body 1 is of a one-piece injection molded or thermoformed construction and includes a bottom wall 2 and a tapered upstanding side wall 3. Polyethylene and polypropylene are suitable plastic materials.

Figure 2:
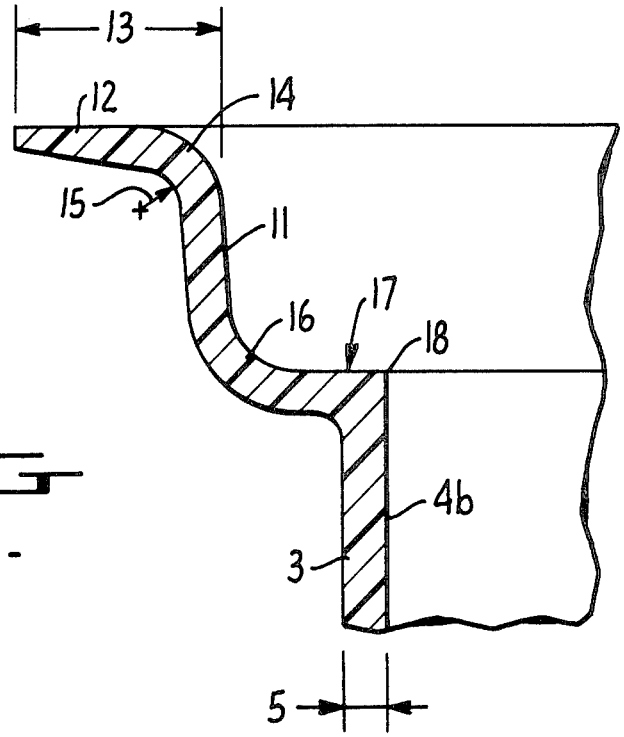
FIG. 2 is an enlarged fragmentary vertical cross-sectional view taken through the upper portion of the container body.

As shown in FIGS. 1 and 2, the upstanding side wall 3 has a generally flat tapered lower major portion 4*a* and a generally cylindrical upper portion 4*b*. In this particular embodiment of the invention, the side wall 3 has a thickness 5 of 0.020 inches. The tapered body provides axial strength along axis 19 to enhance the seaming operation hereafter described.

The cylindrical portion 4*b* of the upstanding side wall 3 includes an upper seam forming portion 11 which terminates at the free end thereof in a gradually tapered radially outwardly directed seaming flange 12. The flange 12 gradually reduces in thickness with the free end being one-half the thickness of the side wall 3 and seam forming portion 11.

In this particular embodiment of the invention, the flange 12 has a flange length 13 of between 0.110 and 0.115 inches. Flange 12 connects to the upper seam forming portion 11 through an outer shoulder section 14 having a sharp radius of curvature 15 between 0.010 and 0.015 inches or in the order of one-half to three quarters of the side wall thickness. The upper seam forming portion 11 connects to the upper portion 4*b* of upstanding side wall 3 through an intermediate radius 16. Intermediate radius 16 has a generally flat inner metal end supporting surface 17 forming an approximately 90° angle 18 with the vertical axis 19 of the container body.

Figure 3:
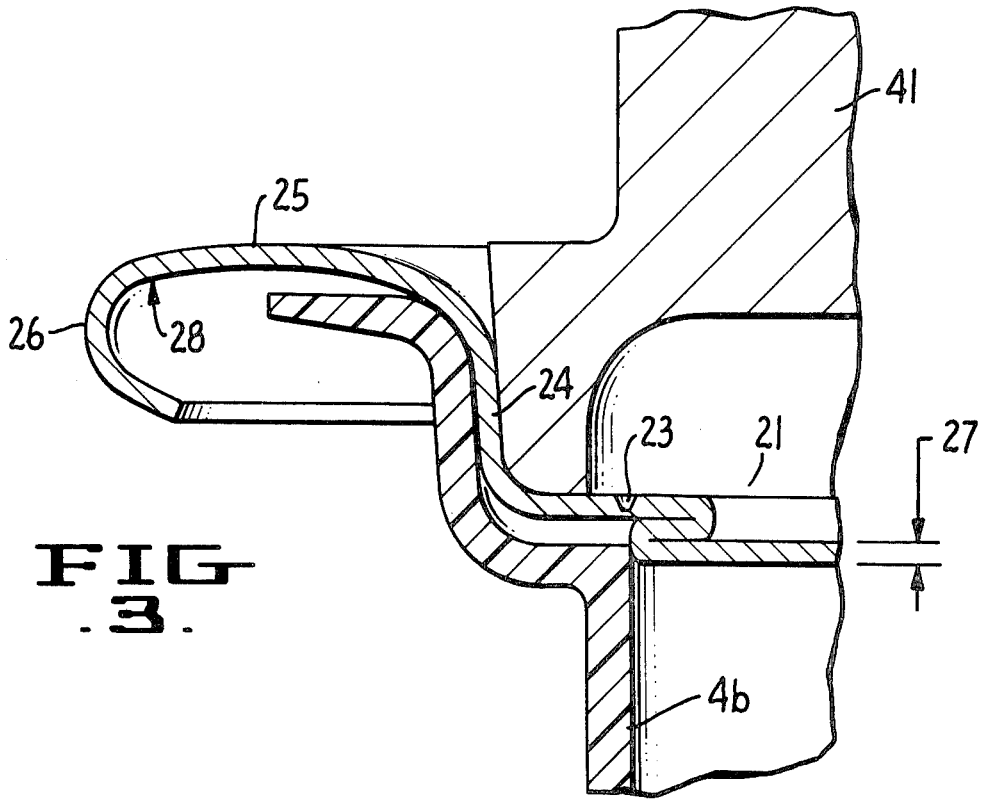
FIG. 3 is a fragmentary vertical cross-sectional view showing the container body with the initial positioning or make-up of a preformed metal end upon it prior to seaming.

In accordance with this invention, a metal end 21 closes the open upper end of the container body. The end preferrably is aluminum and of well-known preformed design for metal containers. The end 21, as is shown in FIGS. 1 and 3, is of the easy opening type and includes a removable end panel 22 which is defined by a peripheral score line 23. The end 21 further includes a chuck wall 24 and a seaming channel 25 which terminates at its free end in a curl 26. In this particular embodiment, end 21 is chosen so that thickness 27 is about 0.010 inches. End 21 is attached to the container body 1 using a conventional double seaming operation. In order to insure a proper seam between the end 21 and the container body 1 sealing compound 28 is applied to the seaming channel 25.

Figure 5:
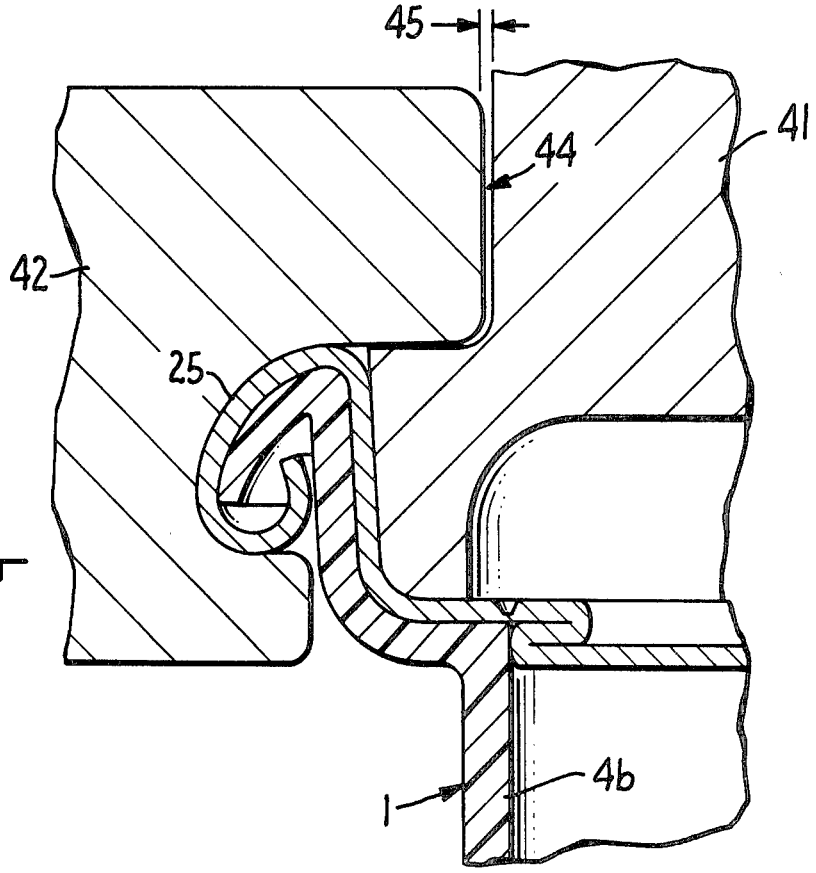
FIG. 5 is a fragmentary vertical cross-sectional view of the container and tooling after the first step of the seaming operation.
Figure 4:
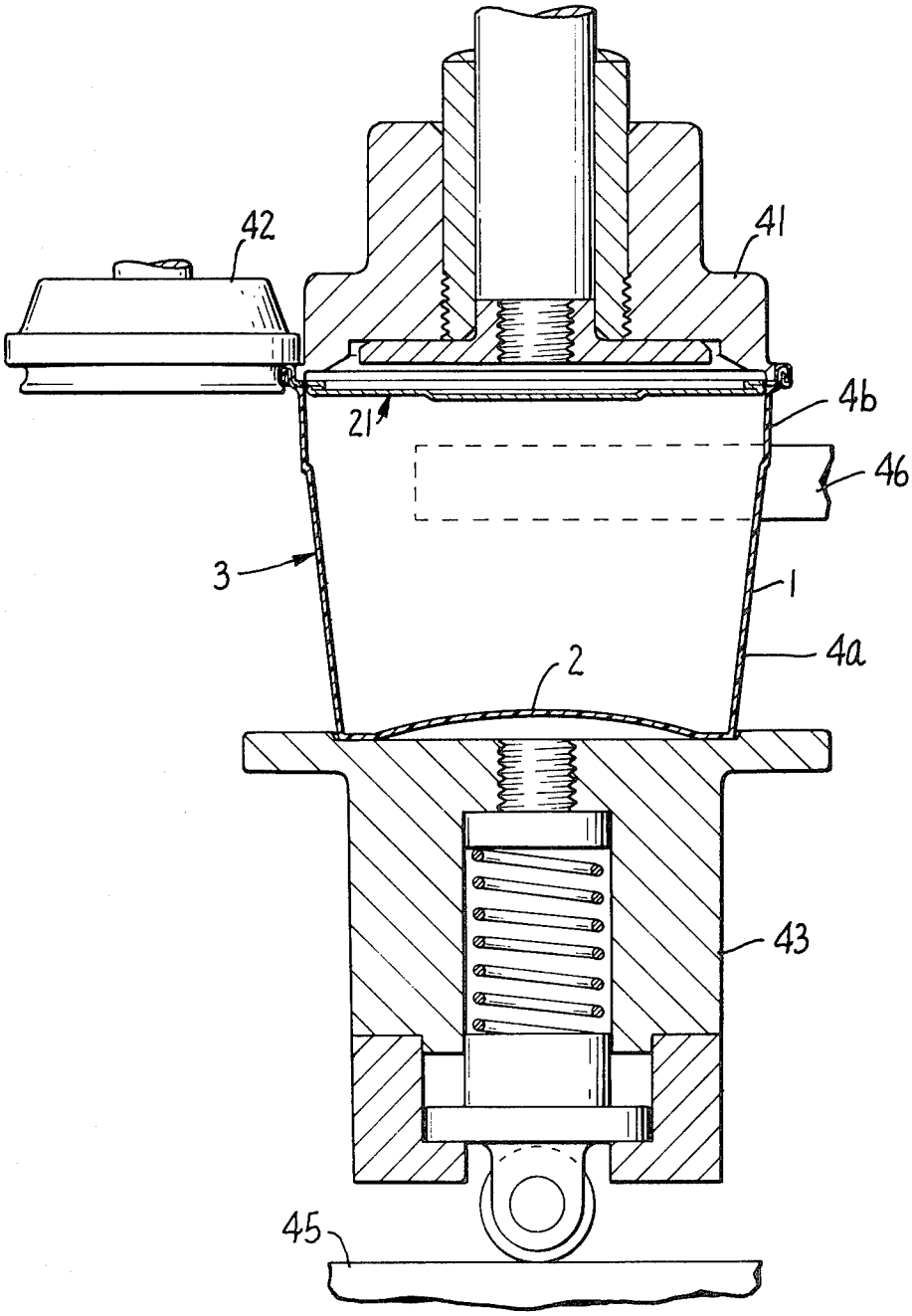
FIG. 4 is a fragmentary vertical sectional veiw taken through the tooling used to seam the metal end onto the container body showing the general position of the tooling, container body and metal end during the seaming cycle.
Figure 6:
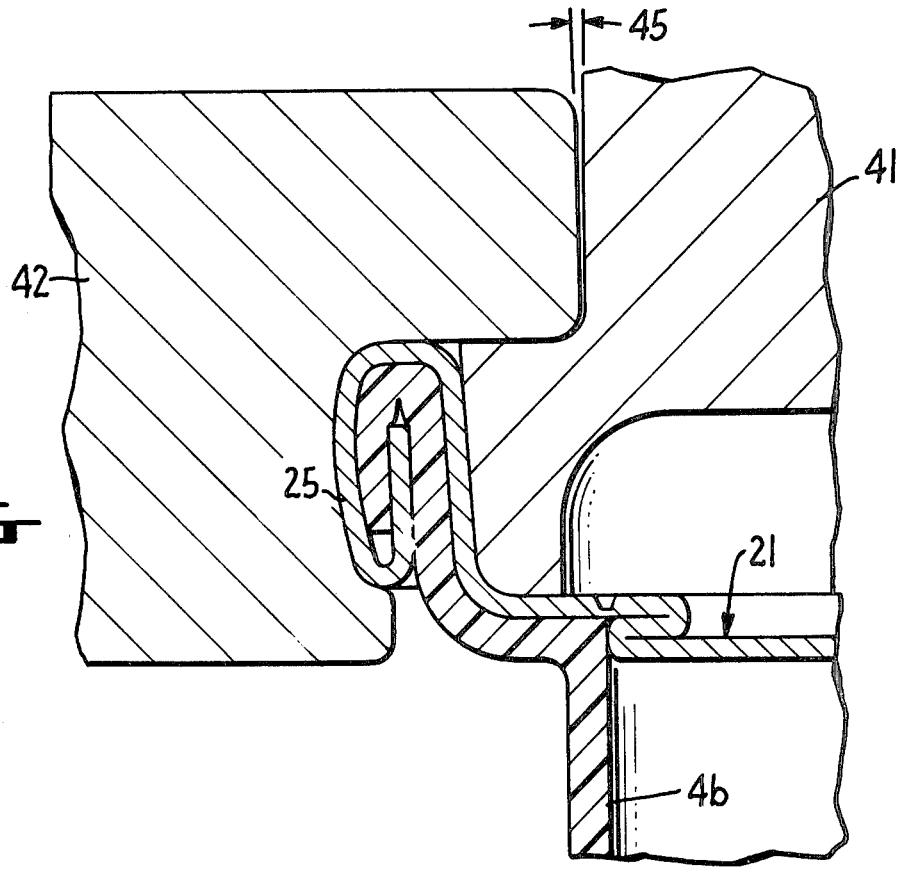
FIG. 6 is a fragmentary vertical cross-sectional view of the container and tooling after the second step of the seaming operation.
Figure 7:
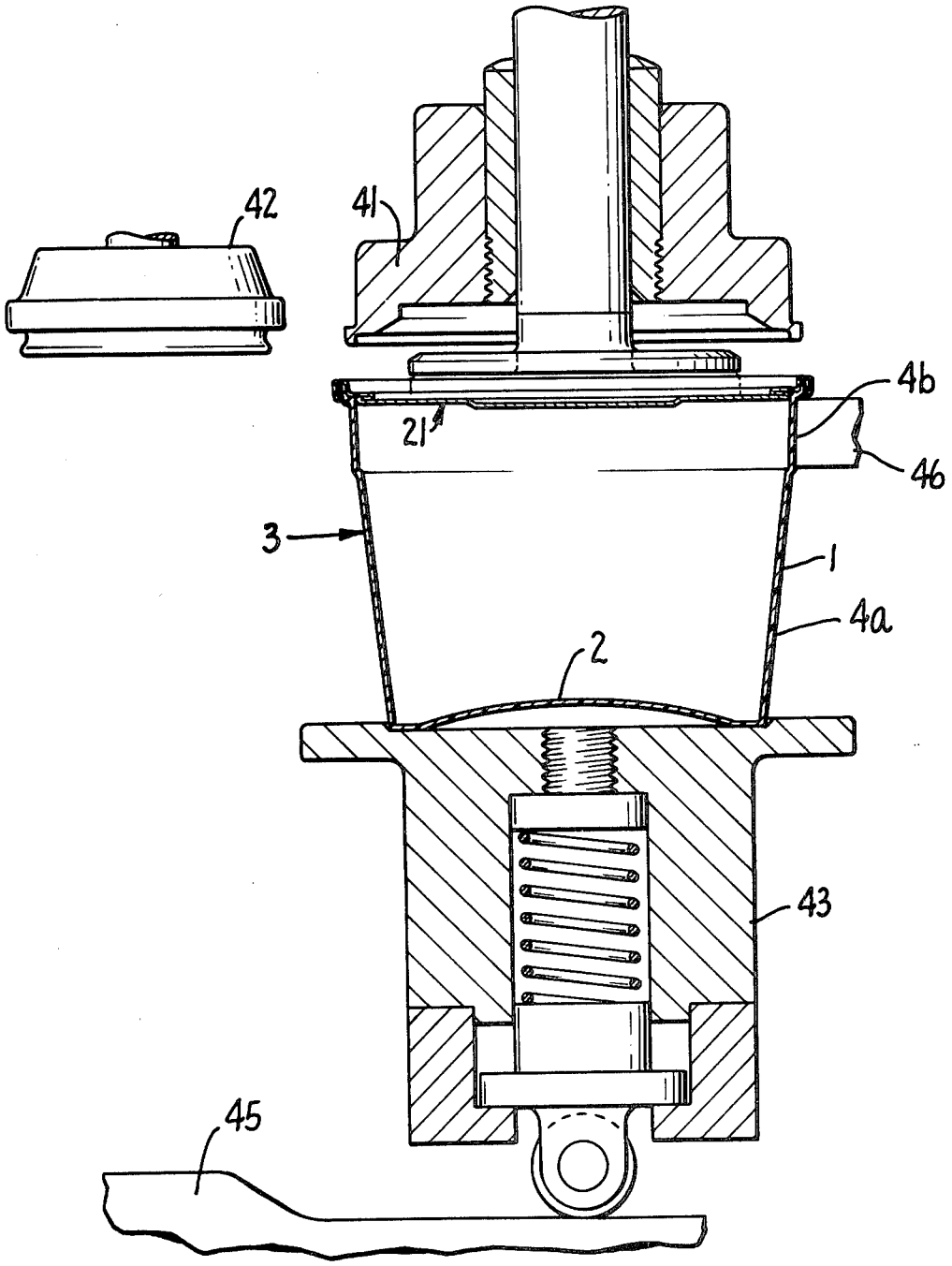
FIG. 7 is a fragmentary vertical sectional view taken through the tooling used to seam the metal end onto the container body showing the position of the tooling, container body and metal end after completion of the seaming cycle.

FIGS. 3, 4, 5, 6 and 7 illustrate the process whereby the metal end 21 is seamed onto the plastic container body 1. In FIG. 3, the metal end 21 is held in place on seaming chuck 41 by locating it between the chuck and container body 1 which is moved upwardly by seaming lifter 43. In FIGS. 5 and 6, the container body 1 is forced upwardly by cam operated seaming lifter 43 against seaming chuck 41. Then seaming roll 42, driven in a horizontal direction by a revolving cam (not pictured in the drawing), rolls seaming channel 25 and curl 26 into the positions shown in FIGS. 5 and 6. In FIG. 6 seaming roll 42 completes the double-seaming operation and forms the channel 25 into the tight double seam of FIG. 8. A small separation 45 exists between the upper portions of seaming roll 42 and seaming chuck 41 when seaming roll 42 has travelled its maximum horizontal distance. As a safety feature of this invention, seaming chuck 41 is designed so that the upper portion of seaming chuck 41 acts as a safety stop 44 to prevent further horizontal travel of seaming roll 42 should the horizontal displacement of seaming roll 42 be out of adjustment. This safety stop 44 eliminates the possibility that cover hook 33 will cut or fracture upper seam forming portion 11 or flange 12 because of pressure applied from seaming roll 42. FIG. 7 shows the sealed container after completion of the seaming operation with seaming lifter 43 retracted by cam 45 and the container resting in mold turret 46.

Figure 8:
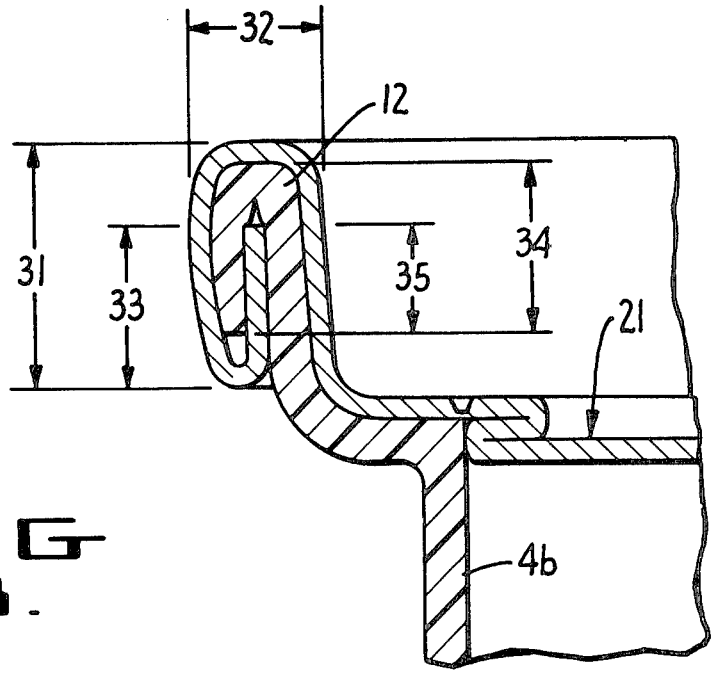
FIG. 8 is a fragmentary vertical cross-sectional view of the container to illustrate certain dimensions and shaping critical to the proper practice of the invention.

FIG. 8 illustrates certain important dimensions of this particular invention. Seam length 31 is in the range of not less than 0.115 nor more than 0.125 inches. Seam thickness 32 is between 0.063 and 0.067 inches. Cover hook 33, formed by the free end of seaming channel 25 and curl 26, is between 0.074 and 0.086 inches, while body hook 34, formed by radially outwardly directed flange 12, is between 0.074 and 0.086 inches. The overlap portion 35 between the cover hook 33 and the body hook 34 is about 40% of the seam length 31. A comparison of the dimension range of the container outwardly-directed sealing flange 12 in FIG. 2 with such dimension range in the finished seal of FIG. 8 (length 34 plus length 32 less twice the metal cap thickness) shows that such body sealing flange is significantly elongated in the seam rolling process by some 6% to 16%. These dimensions are selected such that a tight seal may be formed between the plastic container body 1 and the metal end 21 with only about 65 pounds of upward pressure required from seaming lifter 43. Conventional designs require much more than 65 pounds of upward pressure. That, in turn, increases the probability that the plastic container body 1 will be crushed or deformed during the seaming operation in prior art container designs.

I claim:

1. A method for seaming an easy open metal end upon a plastic container body having a preformed outwardly directed and tapered seaming flange of an initial predetermined radial length, comprising the steps of positioning said body carrying a preformed easy open metal end having a seaming channel and curl overlying said seaming flange in a mold turret below a seaming chuck; lifting said body and metal end upwardly into seaming engagement with said chuck by force applied only to the bottom of the container body; and then seam rolling said metal end upon said body by rolling the seaming channel and curl into a cover hook engaging and pressing the said body seaming flange between said seaming channel and curl and thereby lengthening the same to a resultant predetermined length in excess of said initial predetermined length.

2. The method of claim 1 further comprising the step of limiting the horizontal travel of the seaming roll so as to further prevent the cover hook of said metal end from thinning and embedding into the container body.

* * * * *